US008246089B2

(12) United States Patent
Mueller et al.

(10) Patent No.: US 8,246,089 B2
(45) Date of Patent: Aug. 21, 2012

(54) LOCK FOR A HOUSEHOLD APPLIANCE

(75) Inventors: Heinrich Mueller, Tuttlingen (DE); Axel Rastemborski, Spaichingen (DE); Tobias Fischinger, Rottweil (DE); Frank Rottler, Königsfeld-Neuhausen (DE)

(73) Assignee: Marquardt GmbH, Rietheim-Weilheim (DE)

( * ) Notice: Subject to any disclaimer, the term of this patent is extended or adjusted under 35 U.S.C. 154(b) by 1147 days.

(21) Appl. No.: 11/877,793

(22) Filed: Oct. 24, 2007

(65) Prior Publication Data

US 2008/0100066 A1 May 1, 2008

(30) Foreign Application Priority Data

Oct. 28, 2006 (DE) ..... 10 2006 050 919
Jan. 27, 2007 (DE) ..... 10 2007 004 175

(51) Int. Cl.
*E05B 15/02* (2006.01)

(52) U.S. Cl. ..... 292/341.15; 292/24; 292/341.16; 292/DIG. 69

(58) Field of Classification Search ..... 292/24, 292/341.15, 341.16, DIG. 69
See application file for complete search history.

(56) References Cited

U.S. PATENT DOCUMENTS

| | | | | | |
|---|---|---|---|---|---|
| 475,966 | A * | 5/1892 | Morton | 292/283 |
| 1,358,885 | A * | 11/1920 | Shimocuskies | 70/150 |
| 2,868,577 | A * | 1/1959 | Zingone | 292/99 |
| 3,617,957 | A * | 11/1971 | Brighenti | 337/77 |
| 3,892,933 | A * | 7/1975 | Rocchitelli | 337/77 |
| 4,032,180 | A * | 6/1977 | Pohl | 292/341.16 |
| 4,262,945 | A * | 4/1981 | Paulson | 292/89 |
| 4,365,830 | A * | 12/1982 | Paulson | 292/89 |
| 4,932,707 | A * | 6/1990 | Ekstran | 292/341.17 |
| 6,082,787 | A * | 7/2000 | Chioffi et al. | 292/128 |
| 6,145,898 | A | 11/2000 | Onderka et al. | |
| 6,363,755 | B1 * | 4/2002 | Hapke et al. | 68/12.26 |
| 6,603,377 | B2 * | 8/2003 | Cho et al. | 335/186 |
| 7,775,070 | B2 * | 8/2010 | Lim et al. | 68/12.26 |
| 2003/0160461 | A1 | 8/2003 | Promutico | |
| 2007/0108777 | A1 | 5/2007 | Mueller et al. | |

FOREIGN PATENT DOCUMENTS

| | | |
|---|---|---|
| DE | 39 19 458 | 12/1990 |
| DE | 196 17 050 | 11/1997 |
| DE | 10 2005 017 870 A1 | 11/2005 |
| DE | 601 09 146 | 3/2006 |
| EP | 0 878 576 | 11/1998 |
| EP | 1 304 436 | 4/2003 |

* cited by examiner

*Primary Examiner* — Carlos Lugo
(74) *Attorney, Agent, or Firm* — Burr & Brown

(57) ABSTRACT

The invention relates to a lock, in particular for a household appliance such as a tumble drier, a washing machine, a dishwasher or the like, having a movable retaining element, which is configured in particular in the manner of a slide. The retaining element interacts with a closure hook located on a closure element, such as a door, a cover, a flap or the like of the household appliance, which can be moved between an open and a closed state. The closure hook, in the closed state of the closure element, engages into the retaining element. Here, the closure hook is held by the retaining element in contact against a blocking face in such a way that a movement of the closure element into the open state is blocked. The blocking face is designed so as to be pivotable in the manner of a positive opener.

10 Claims, 21 Drawing Sheets

LOCK FOR A HOUSEHOLD APPLIANCE

This application claims the benefit under 35 USC §119(a)-(d) of German Application No. 10 2006 050 919.6, filed Oct. 28, 2006, and German Application No. 10 2007 004 175.8, filed Jan. 27, 2007, the entireties of which are incorporated herein by reference.

FIELD OF THE INVENTION

The present invention relates to a lock for a household appliance.

BACKGROUND OF THE INVENTION

Household appliances, such as a tumble drier, a washing machine, a dishwasher or the like, have a door, a cover, a flap or the like to allow loading and/or unloading. The door, the cover, the flap or the like, also referred to below as the closure element, is provided with a lock.

DE 10 2005 017 870 A1 discloses a lock of said type. The lock has a moveable retaining element, which is configured in the manner of a slide, for interacting with a closure hook located on a closure element of the household appliance which can be moved between an open and a closed state. The closure hook, in the closed state of the closure element, engages into the retaining element, with the closure hook then being held by the retaining element in contact against a blocking face. In this way, a movement of the closure element into the open state is blocked, and the closure element is therefore held in the closed state. For safety reasons, it has proven to be disadvantageous for it to be possible for the closure element to be opened only from the outside of the household appliance.

SUMMARY OF THE INVENTION

The invention is based on the object of refining the lock in such a way that the closure element can also be opened from the inside of the household appliance.

In the lock according to the invention, the blocking face is designed so as to be pivotable in the manner of a positive opener. In this way, the closure element can also be opened, with little force, from the inside of the household appliance.

In a compact further embodiment, the blocking face has a shaft for pivotable mounting. The blocking face is acted on at one side, in particular at the one end of the shaft, with an elastic force in the movement direction of the closure hook. In this way, the blocking face, as a result of a force acting in the movement direction of the closure hook, is moveable at one side counter to the elastic force. Said deflection of the blocking face with respect to the closure hook then permits pivoting of the blocking face, in order to thereby allow the closure element to be flung open from the inside of the household appliance in emergencies. The elastic force can, in a simple way, be generated by means of a spring, for example by means of a leaf spring and/or an approximately fork-shaped leg spring in a manner particularly adapted to the shape of the lock.

A carrier part, which stands approximately perpendicularly on the blocking face, is expediently arranged on the shaft. It is possible for a lug to be situated on the carrier part, with the closure hook, during the movement of the closure element into the closed state, acting on the lug in order to pivot the blocking face back. In this way, the closure can be placed back into the initial state after the flinging-open of the closure element from the inside.

When the household appliance is in operation, it is generally desirable that the closure element cannot be opened either from the outside or from the inside. In order to prevent opening from the outside, the retaining element can interact with a two-state locking mechanism, in such a way that the locking mechanism in a first state blocks the movement of the retaining element and in a second state frees the movement of the retaining element. For the purpose of simple and automated actuation, it is expedient if it is possible for the locking mechanism to be electromagnetically controlled between the two states.

In a very simple embodiment, the locking mechanism has a pivotably movable blocking element, with the blocking element, at its one end, in the first state being in interaction with the retaining element and in the second state being free from interaction with the retaining element. At the other end of the blocking element, a rocker switch, which is switchable between two settings, is operatively connected to the electromagnet. The operative connection is produced by means of a push rod which can be moved by means of the electromagnet, with the push rod engaging, for switching purposes, into a connecting link, which is for example of approximately W-shaped configuration, on the rocker switch.

In order to prevent an opening of the closure element from the inside, it is also expedient for a lever-like rotatable blocking plate to interact with the blocking face, specifically in particular with the shaft. In this way, the single-sided movement of the blocking face counter to the elastic force is permitted, with opening from the inside again being possible, and/or prevented, with opening from the inside then not being possible. In a simple embodiment, it is expedient for the blocking plate to be rotated by means of the pivotable blocking element. For this purpose, the blocking plate can expediently be rotated by the blocking element via a fork-journal connection.

In summary, for a particularly preferred embodiment, the following is to be noted. The lock has the possibility, in the unlocked state of the block, for the door of a household appliance, for example of a washing machine, to be opened from the inside.

If, in the unlocked state of the block, a force, for example of approximately 50 N, is introduced at the force engagement face, for example by pressing against the door from the inside, then the lock opens as follows. The positive opener is lowered at one side, on the side of the spring, by a small amount of approximately 1 mm. In this way, the positive opener passes below the edge of the snap-action hook on the cover of the housing for the lock, thereby permitting tilting of the positive opener. On account of the force which acts, the positive opener then tilts. The hook of the door then slides out of the lock on the now-tilted force engagement face, and the door is open. If the hook has been moved out of the lock and the positive opener has been unlocked, that is to say is in the tilted position, then the positive opener can, by closing the door, be placed back into the basic position by virtue of the hook pressing the positive opener back against the lug.

In the locked state of the block, the block prevents the positive opener from moving downward, as a result of which a rotational movement of the positive opener as a result of the force of the hook acting on the force engagement face is prevented. In this way, it is not possible for the hook to slide out, and the lock remains closed even in the event of relatively large forces acting.

In a further embodiment, the shaft can have a pivot axis which is arranged offset with respect to the center. In this way, an increased lever arm again acts as the positive opener pivots back, as a result of which the positive opener automatically returns to the initial state after the opening of the closure element on the lock. In one refinement, the pivot axis which is arranged offset with respect to the center is realized in that the cross section of the shaft which acts for the pivoting action is configured so as to be of a shape which deviates from circular, in particular so as to be approximately half-moon-shaped, pear-shaped or the like.

In summary, for said preferred embodiment, the following is to be noted. The lock has the possibility, in the unlocked state of the block, for the door of a household appliance, for example of a washing machine, to be opened from the inside.

If, in the unlocked state of the block or the shaft, a force, for example of 50 N, is introduced at the force engagement face, for example by pressing against the door from the inside, then the lock opens as follows. The positive opener is lowered at one side, on the side of the spring, by a small amount, for example, approximately 1.6 mm. In this way, the positive opener passes below the edge of the counter bearing on the cover of the lock, thereby permitting tilting of the positive opener. On account of the force which acts, the positive opener tilts. The hook of the door then slides out of the lock on the now-tilted force engagement face, and the door is open.

If the hook has slid out of the lock, then the positive opener automatically returns into the basic position. This takes place on account of a restoring torque which is generated by the leg spring. Since said restoring function counteracts the tilting or triggering of the positive opener, a balance must be struck here for the force calibration.

In the locked state of the block, the block prevents the positive opener both from moving downward and from tilting, as a result of which a rotational movement of the positive opener as a result of the force of the hook acting on the force engagement face is prevented. In this way, it is not possible for the closure hook to slide out, and the lock remains closed even in the event of relatively large forces acting.

The advantages obtained by means of the invention consist in particular in the fact that, in emergencies, the door can easily be opened from the inside. Such emergencies could for example involve a child being situated in the drum of the washing machine. Accordingly, safety is increased in the household appliance even in safety-critical applications. The lock is nevertheless, despite a high level of functionality, cost-effective and therefore suitable in particular for expensive household appliances. In addition, a lock of such design is small and compact, and therefore suitable for restricted installation spaces in household appliances.

DETAILED DESCRIPTION OF THE INVENTION

Exemplary embodiments of the invention having different refinements and embodiments are illustrated in the drawings and are described in greater detail below.

FIG. 1 schematically shows a household appliance having a door and a lock;

FIGS. 2*a* to 2*c* show a diagrammatic sketch for the opening and/or closing of the door corresponding to the detail II from FIG. 1;

FIGS. 16 to 23 also show in each case a further detail view of the present invention.

DETAILED DESCRIPTION OF THE INVENTION

Figure 1:
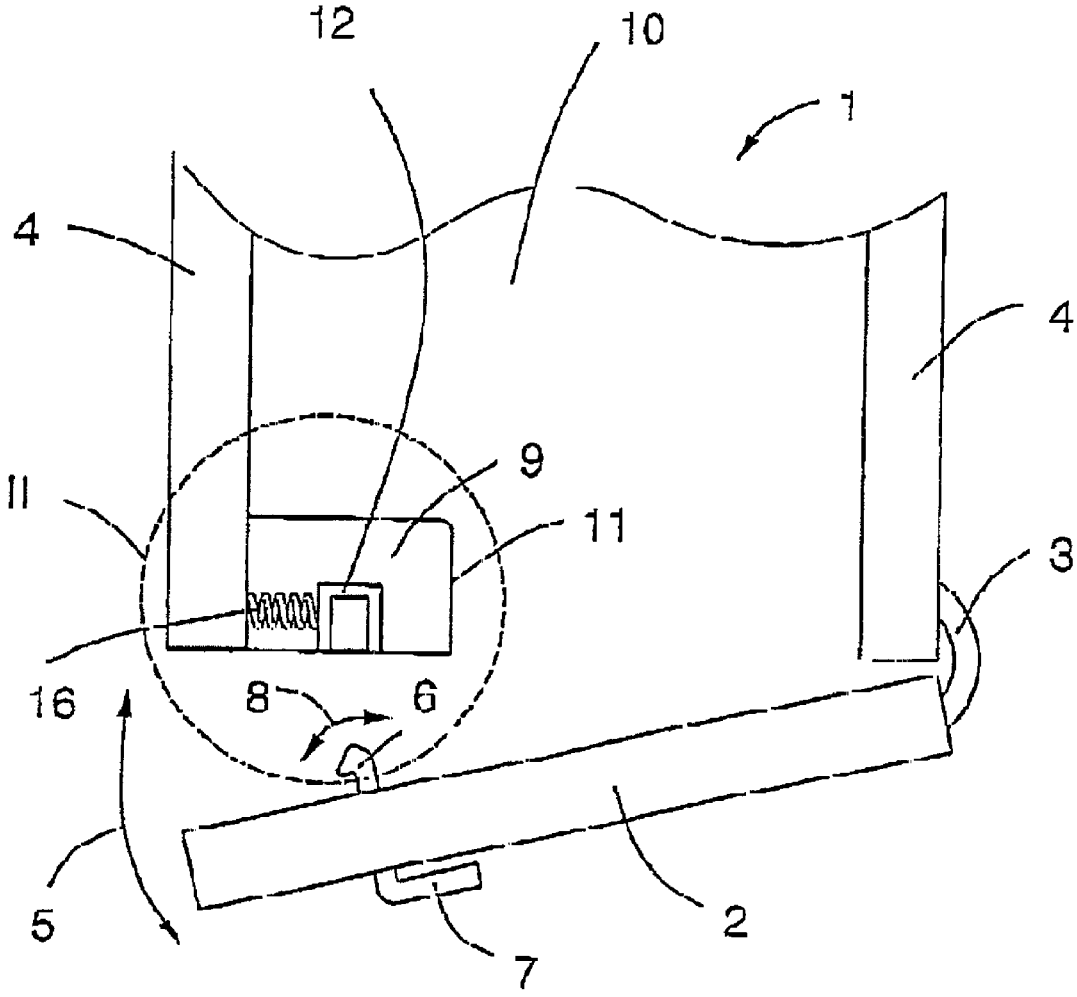

FIG. 1 shows a household appliance 1, such as a tumble drier, a washing machine, a dishwasher or the like, which has a door, a cover, a flap or some other moveable part as a closure element 2, referred to for simplicity below merely as a door, for an interior space 10. The door 2 is fastened to the body 4 of the household appliance 1 by means of a hinge 3 so as to be moveable in a pivoting direction 5, and is thus moveable between an open and a closed state. Located on the door 2 is a closure hook 6 which can be deflected in a deflection direction 8 by the user by means of a handle 7, which closure hook 6 interacts correspondingly, as the door 2 is opened and/or closed, with a lock 9 which is attached to the body 4.

Figure 2A:
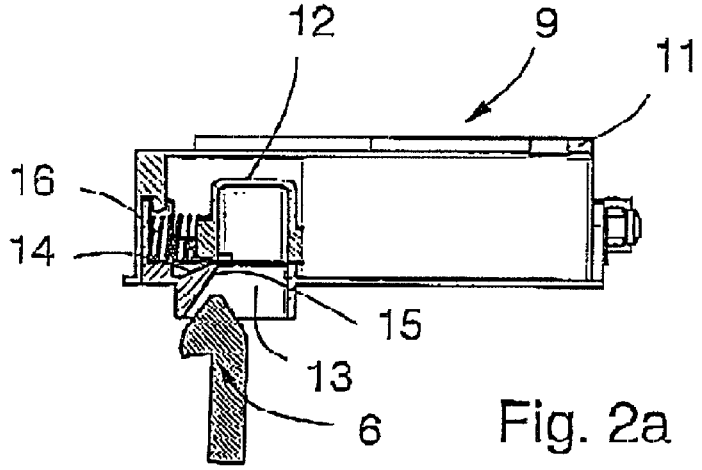
Figure 2B:
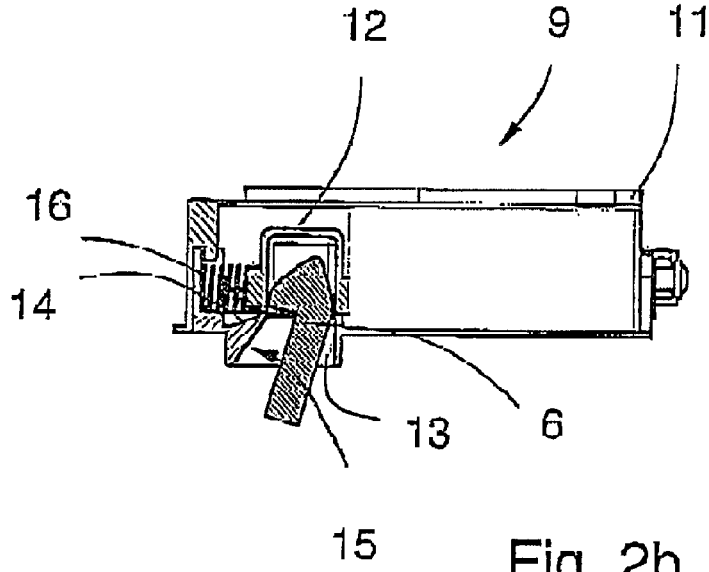
Figure 2C:
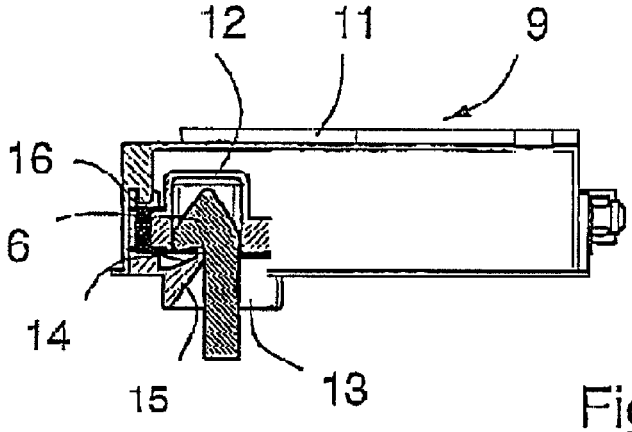

The interaction of the closure hook 6 with the lock 9 as the door 2 is closed and/or opened is illustrated in greater detail in FIGS. 2*a* to 2*c*. The lock 9 has a housing 11 in which a retaining element 12, which is embodied in the present case in the manner of a slide, is mounted so as to be moveable counter to a spring 16. If, during the closing process, the door 2 is moved to the body 4, then the closure hook 6 passes, as per FIG. 2*a*, to an opening 13, which corresponds with the slide 12, in the housing 11. Located in the housing 11 is a blocking face 14 with an insertion bevel 15 which faces toward the opening 13. The closure hook 6 is, as per FIG. 2*b*, correspondingly deflected on the insertion bevel, so that the closure hook 6 can engage into the slide 12. On account of the restoring force of the closure hook 6, the slide 12 is then placed into the position shown in FIG. 2*c* counter to the force of the spring 16. As per FIG. 2*c*, in the closed state of the door 2, the closure hook 6 engages into the slide 12, and is thereby held by the slide 12 in contact against the blocking face 14, in such a way that an automatic movement of the door 2 into the open state is blocked. In order to open the door 2, it is in fact necessary for the closure hook 6 to be deflected by the user by means of the handle 7, so that the slide 12 is placed into the position shown in FIG. 2*b*, in which the door 2 can then be opened, corresponding to FIG. 2*a*.

There is the risk of a person, for example a child, being situated in the interior space 10 of the household appliance 1. In order to permit opening and/or flinging-open of the door 2 from the interior space 10 in such emergency situations, the blocking face 14 is designed so as to be pivotable in the manner of a positive opener 17. The more detailed design of a lock 9 of said type can be seen in perspective view in FIG. 3.

For pivotable mounting of the positive opener 17 in the housing 9, the blocking face 14 has a shaft 18. Arranged on the shaft 18 is a carrier part 19 which stands approximately perpendicularly on the blocking face 14. Located in turn on the carrier part 19 is a lug 20 which is assigned substantially to the slide 12.

Figure 10:
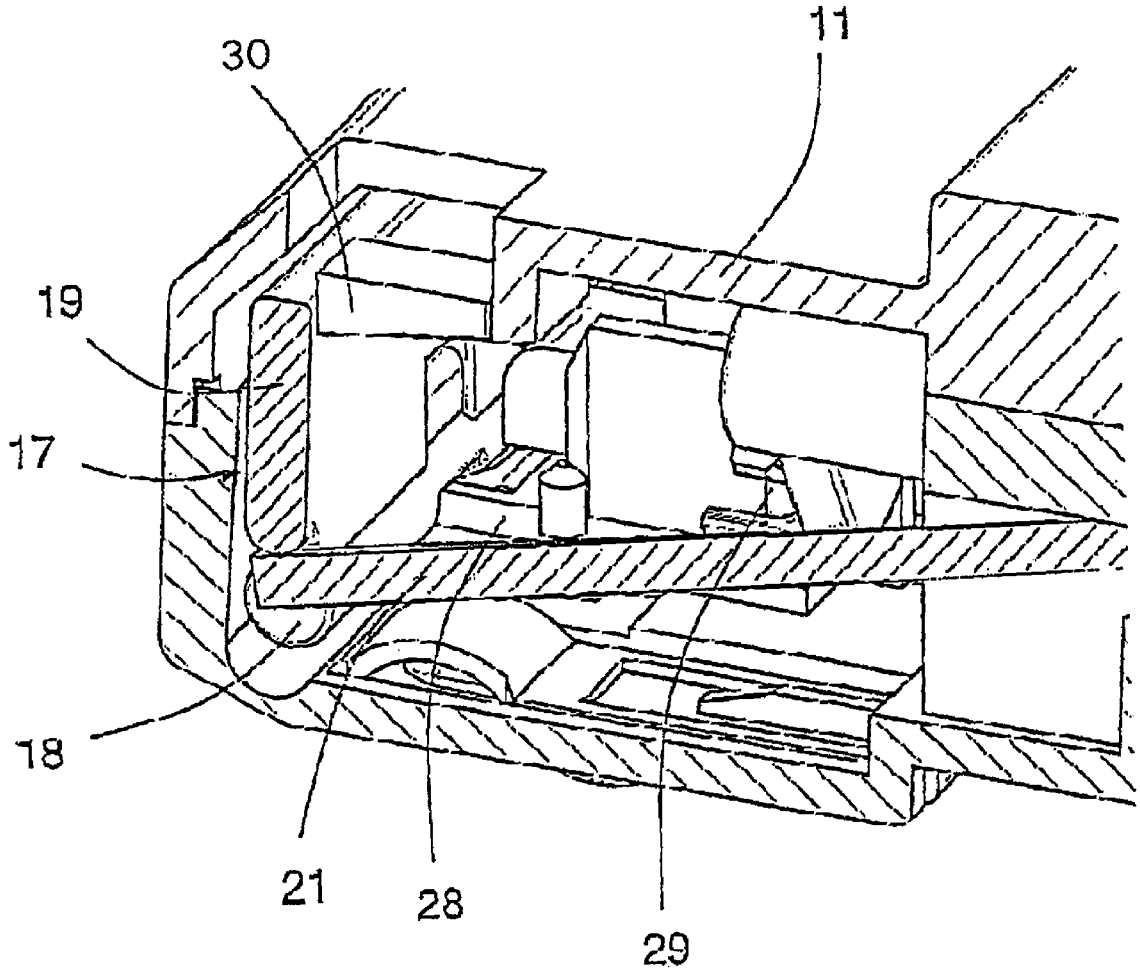
FIG. 10 shows a section along the line 10-10 in FIG. 3, with emergency opening being permitted.

In addition, the blocking face 14 is acted on at one side, specifically at the one end of the shaft 18, with an elastic force in the movement direction of the closure hook 6, as can be seen from FIG. 10. In this way, as a result of a force, which is exerted by the pressure on the door 2 from the interior space 10, acting in the movement direction of the closure hook 6, the blocking face 14 is moveable at one side counter to the elastic force, in such a way that a pivoting of the blocking face 14 is then permitted in order to release the closure hook 6. The elastic force is generated by means of a spring, specifically in the present case by means of a leaf spring 21. During a subsequent movement of the door into the closed state, the closure hook 6 acts on the lug 20 so as to pivot the blocking face 14 back.

Figure 4:
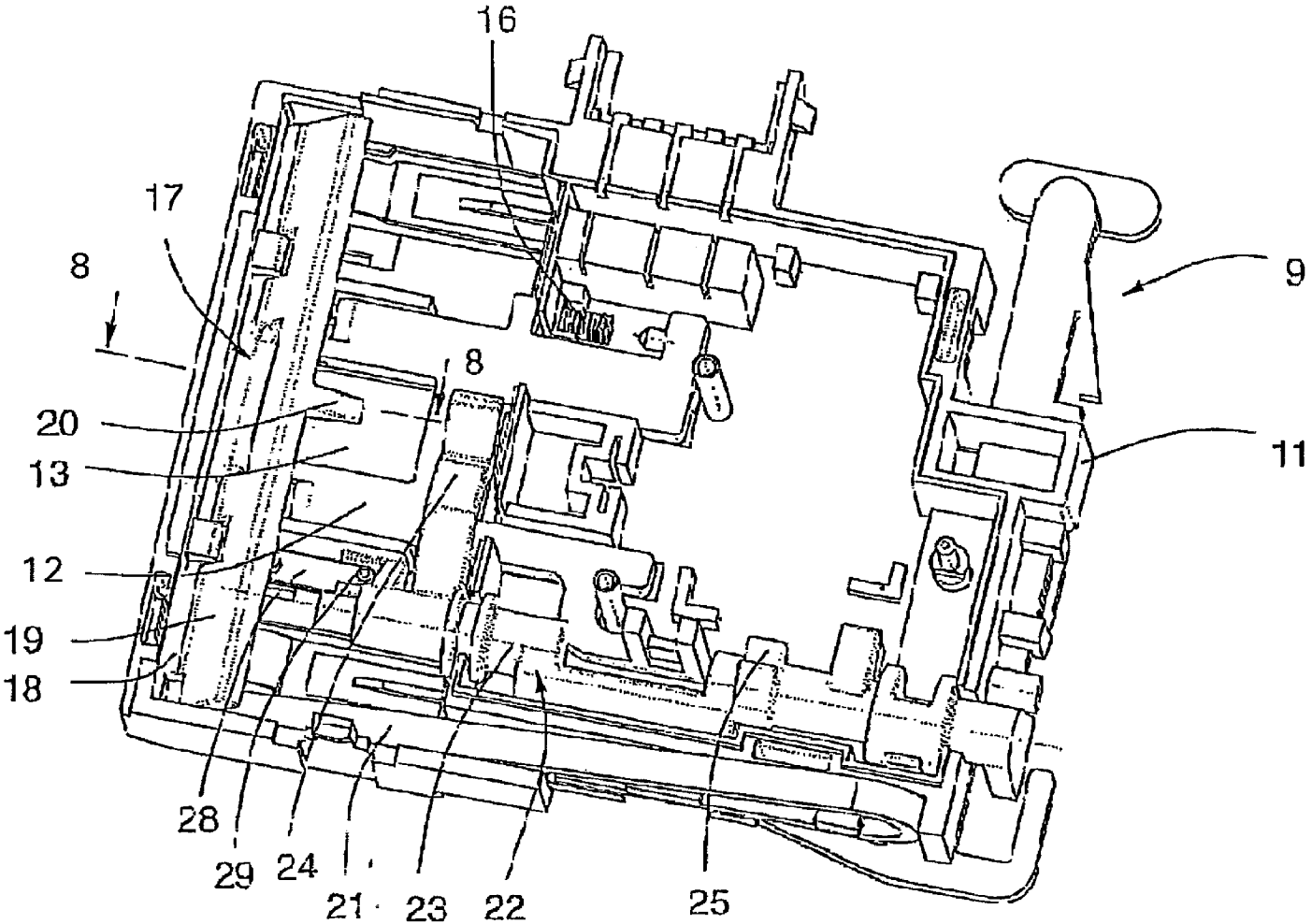
FIG. 4 shows the lock as in FIG. 3, after the emergency opening has taken place.
Figure 6:
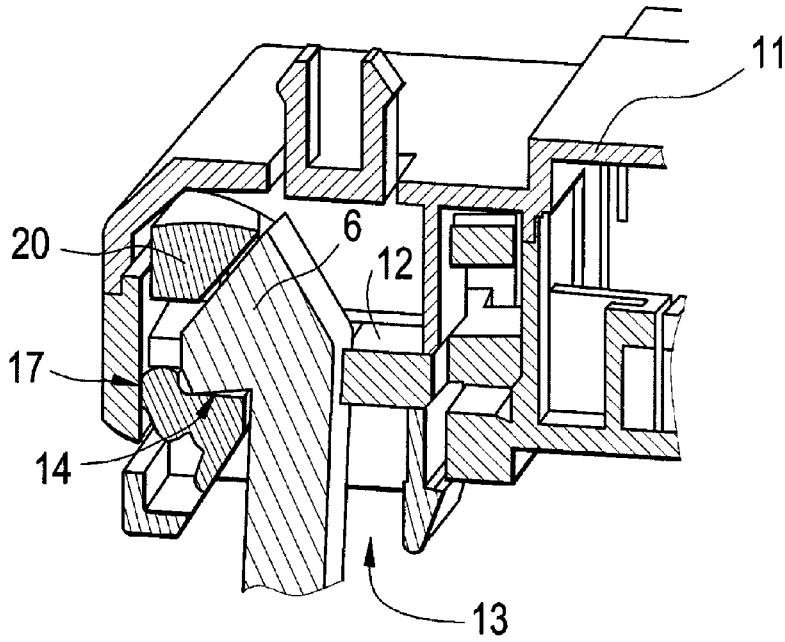
FIG. 6 shows a section along the line 6-6 in FIG. 3, with the door closed.
Figure 7:
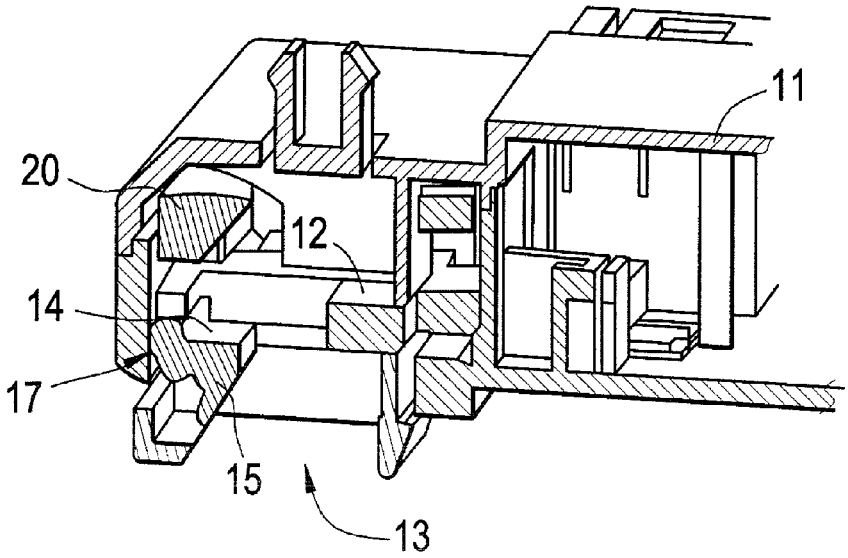
FIG. 7 shows a section as in FIG. 6, with the closure hook removed.
Figure 8:
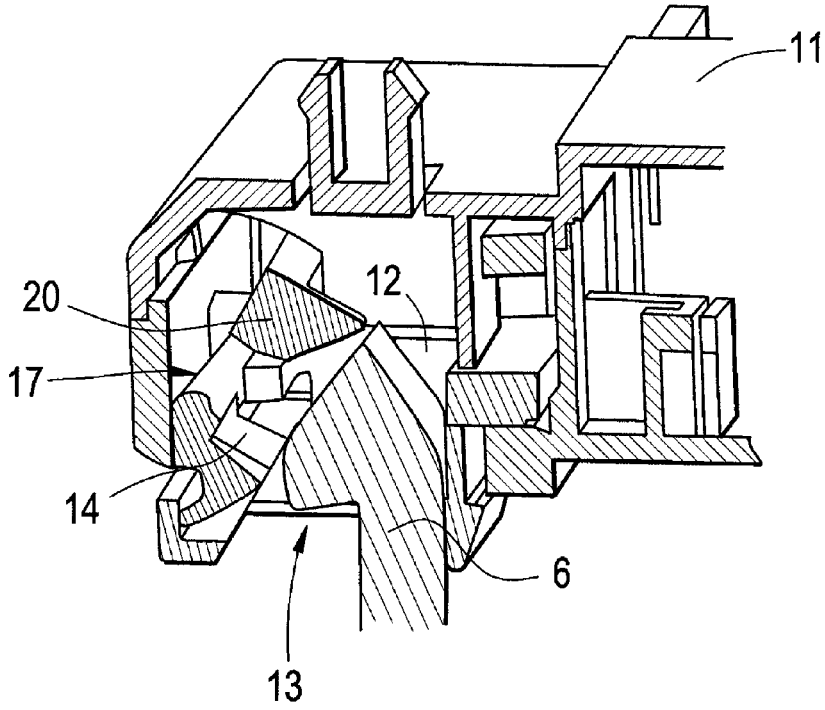
FIG. 8 shows a section along the line 8-8 in FIG. 4, with the door still closed.
Figure 9:
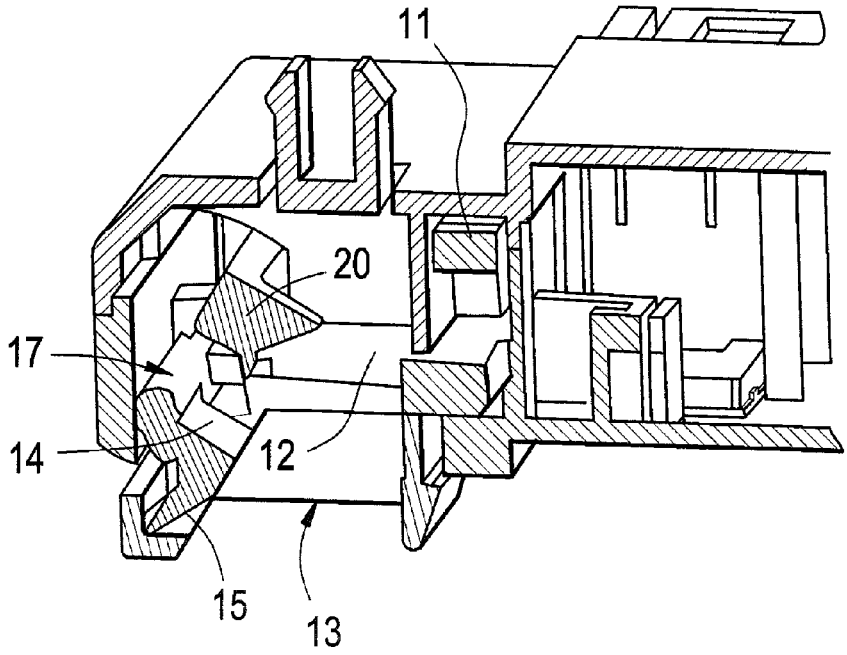
FIG. 9 shows a section as in FIG. 8, with the closure hook removed.
Figure 11:
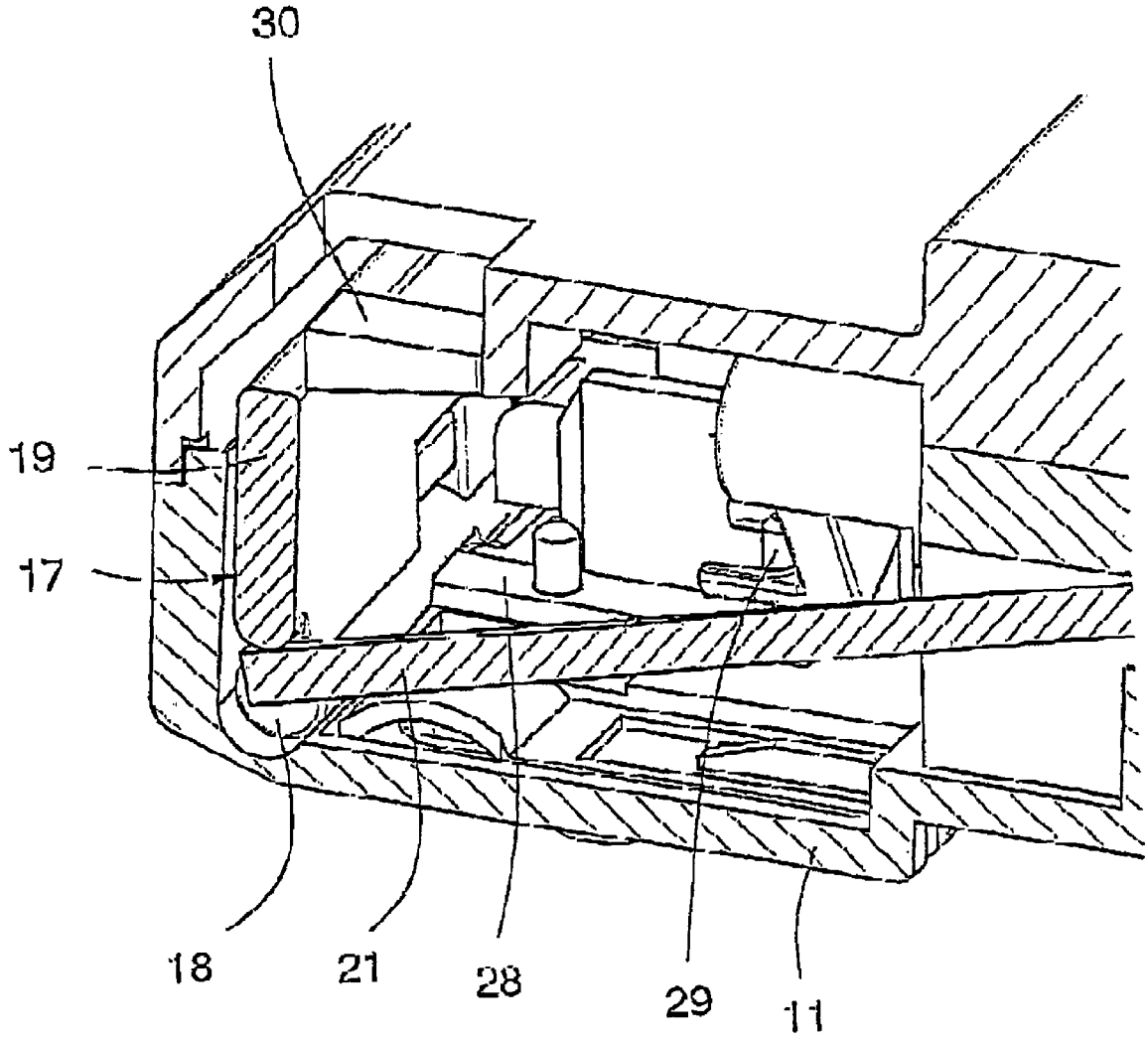
FIG. 11 shows a section as in FIG. 10, with the positive opener lowered.
Figure 12:
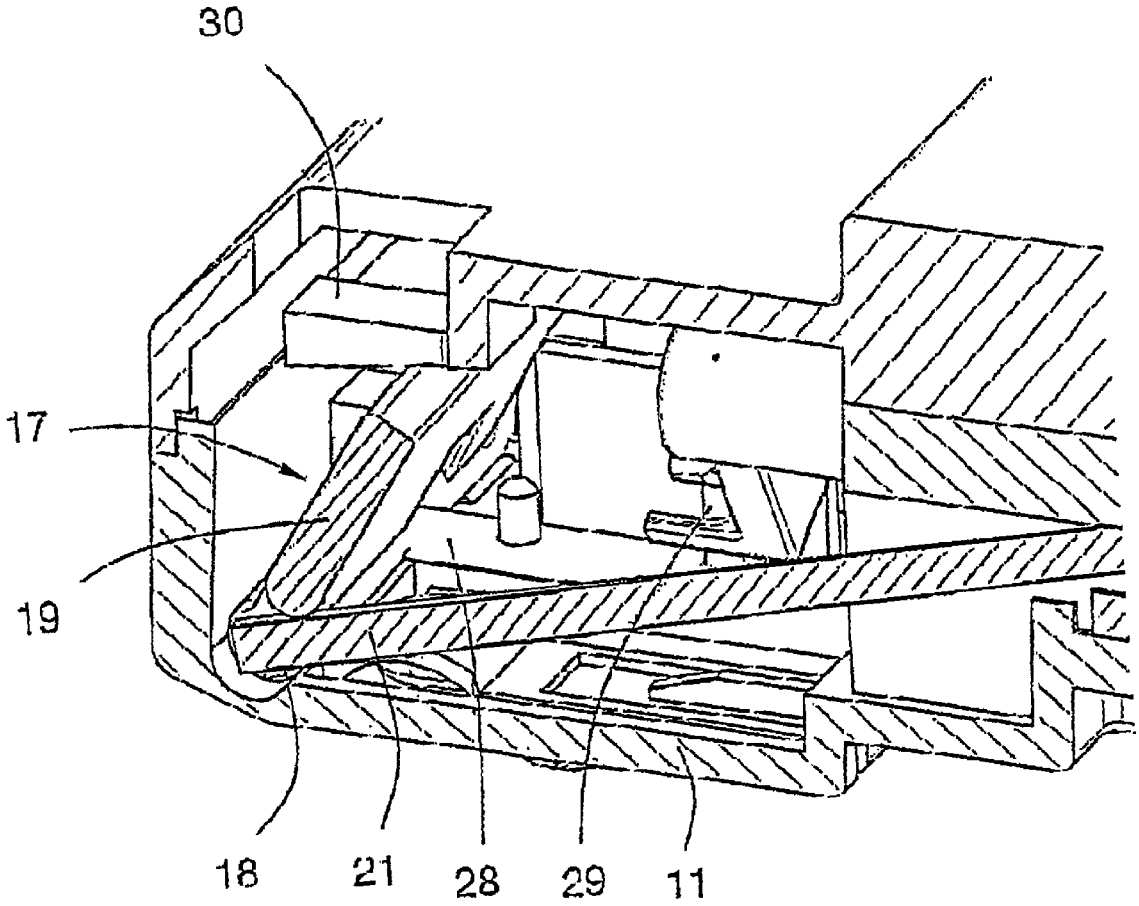
FIG. 12 shows a section as in FIG. 10, with the positive opener pivoted.
Figure 13:
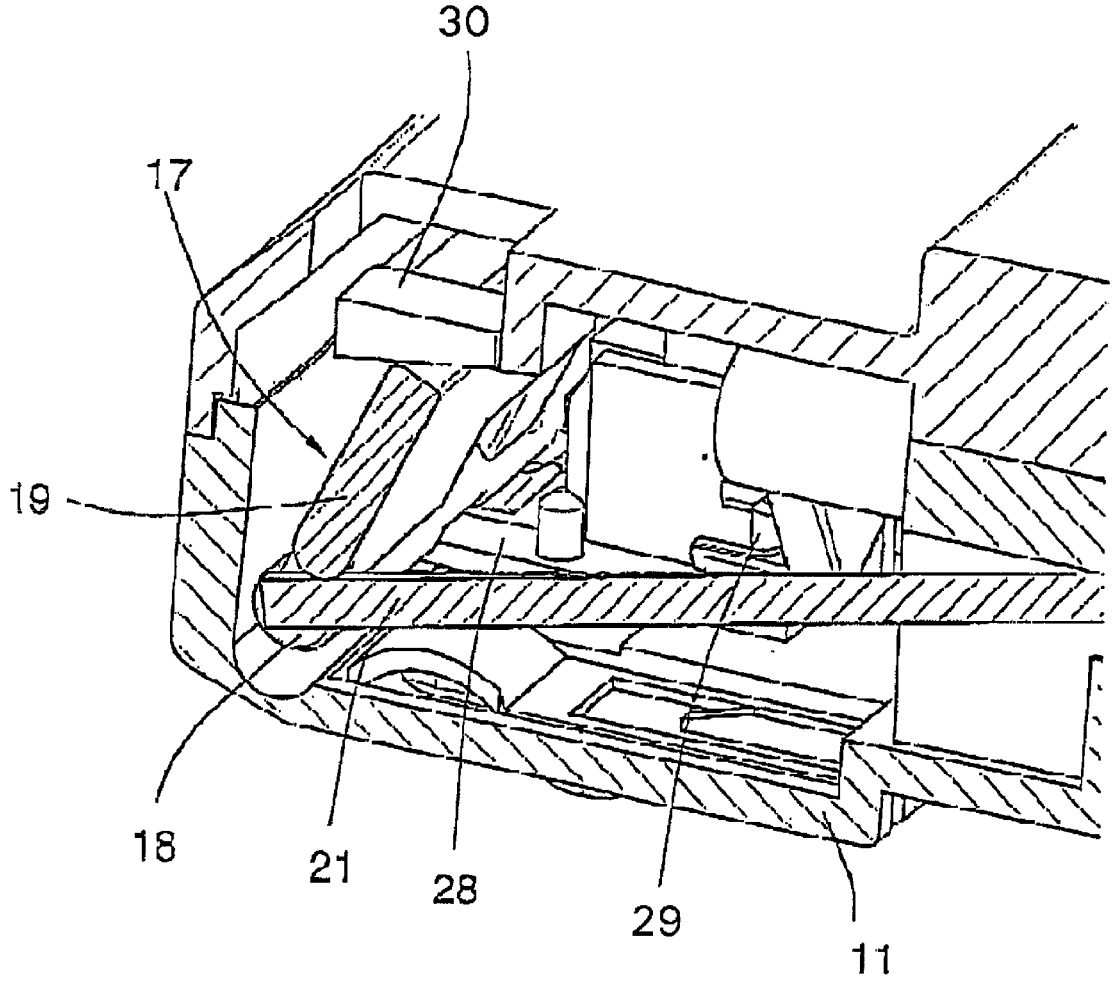
FIG. 13 shows a section as in FIG. 10, with emergency opening having taken place.

The mode of operation as the door 2 is opened from the interior space 10 is now as follows. If, corresponding to FIG. 6 and FIG. 7, a force is introduced at the force engagement face of the blocking face 14 as a result of the door 2 being pressed from the interior space 10, then the lock 9 opens as follows. The positive opener 17 is lowered at one side, on the side of the leaf spring 21, by a small magnitude, as can be seen in FIG. 11. As a result, the positive opener 17 passes below the edge of a snap-action hook 30 on the cover of the housing 11, as shown in FIG. 11, as a result of which tilting of the positive opener 17 is permitted. On account of the force acting, the positive opener 17 then tilts as per FIG. 12. The closure hook 6 of the door then slides out the lock 9 on the now-tilted force engagement face of the blocking face 14, corresponding to FIG. 8 and FIG. 9, and the door 2 is open. Said state of the lock 9 is shown in perspective view in FIG. 4. If the closure hook 6 is situated outside the lock 9 and the positive opener 17 is in the tilted position, as can be seen in FIG. 13, then the positive opener 17 can, by closing the door 2, be placed back into its basic position by virtue of the closure hook 6 pressing the positive opener 17 back against the lug 20, as can be seen from FIG. 4.

During operation of the household appliance 1, for example when water is in the drum of the washing machine, the door 2 can be locked for safety reasons, with opening of the door 2 from the interior space 10 then also no longer being necessary. For this purpose, a two-state locking mechanism 22 (shown in FIG. 3) is located in the housing 11, which locking mechanism 22 interacts with the slide 12 in such a way that the locking mechanism 22 in a first state blocks the movement of the slide 12 and in a second state frees the movement of the slide 12. The locking mechanism 22 can be directly electromagnetically controlled between the two states, for which purpose an electromagnet 26 (indicated merely schematically in FIG. 3) which can be acted on with electrical voltage is arranged in the housing 11.

Figure 3:
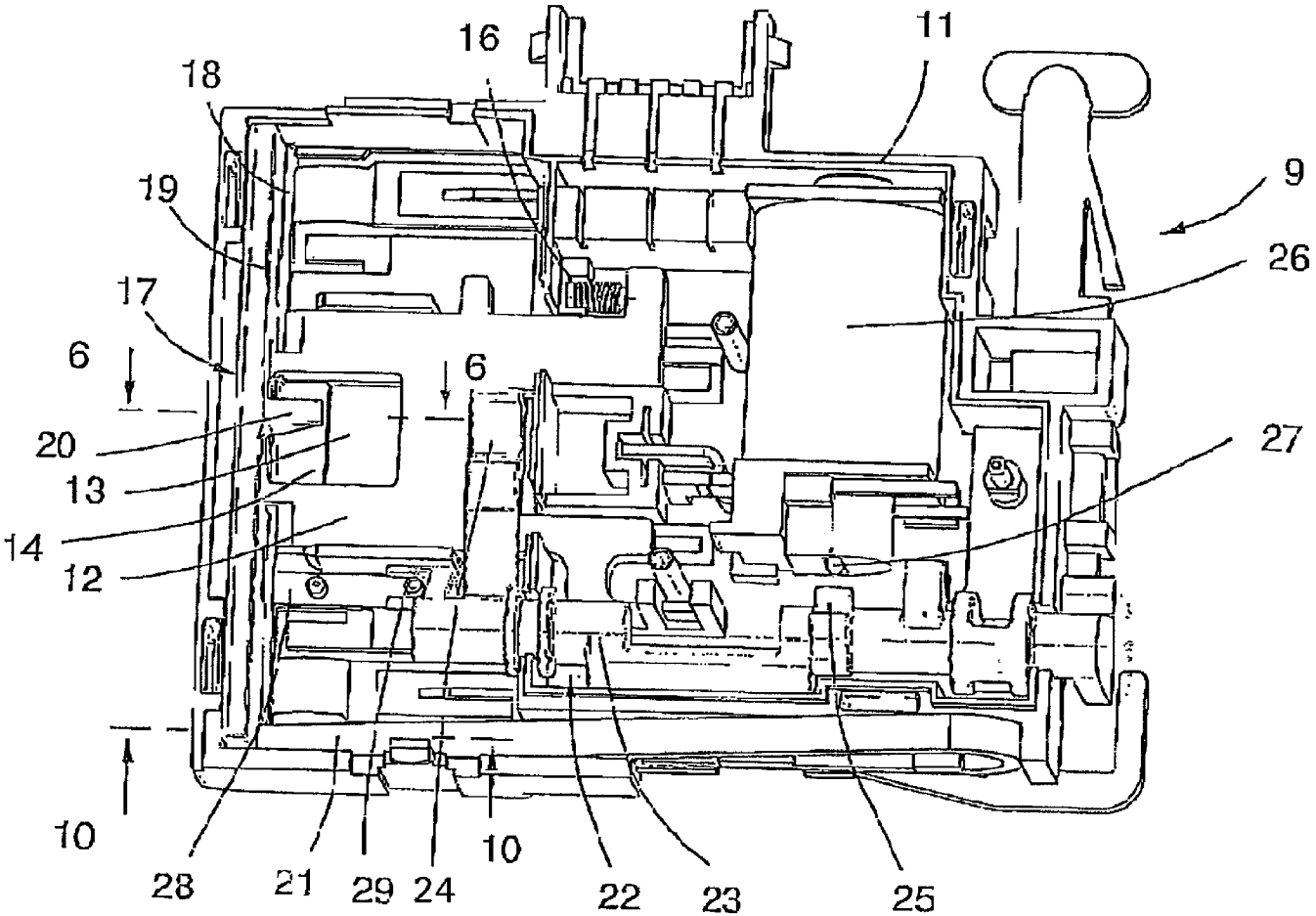
FIG. 3 shows the lock in a perspective view, with emergency opening being permitted.

The locking mechanism 22 has a movable blocking element 23, which in the present case is of pivotable design. The one end of the blocking element 23 in the first state is in interaction with the slide 12 and in the second state is free from interaction with the slide 12. The pivotable blocking element 23 of the locking mechanism 22 has, in particular at one end, a blocking vane 24 which in the first state bears against the slide 12 and thereby blocks the movement of the slide 12 counter to the spring 16, so that the door 2 cannot be opened by the user, which is shown in greater detail in FIG. 5. Located on the blocking element 23, in particular at its other end, is a rocker switch 25 which is switchable between two settings and which is integrally formed on the blocking element 23 and is operatively connected to the electromagnet 26. The operative connection to the rocker switch 25 is produced by means of a push rod 27 which can be moved by means of the electromagnet 26, with the push rod 27 engaging, for switching purposes, into a connecting link, which is for example of approximately W-shaped configuration, on the rocker switch 25. After the switching of the locking mechanism 22, the blocking vane 24 in the second state passes out of contact with the slide 12, as a result of which the movement of the slide 12 counter to the spring 16 is freed, as can be seen in FIG. 3, so that the door 2 can then be opened again by the user. For a more detailed description of the locking mechanism 22, reference is made to DE 10 2005 017 870 A1.

If the door 2 has been locked by means of the locking mechanism 22 during operation of the household appliance 1, then emergency opening of the door 2 from the interior space 10 is no longer necessary and is therefore prevented. For this purpose, a lever-like rotatable blocking plate 28 interacts with the blocking face 14, specifically with the shaft 18 for the blocking face 14. On account of said interaction, the single-sided movement of the blocking face 14 counter to the elastic force exerted by the leaf spring 21 is permitted and/or prevented. The blocking plate 28 is rotated by means of the pivotable blocking element 23, for which purpose the blocking plate 28 can be rotated by the blocking element 23 via a fork-journal connection 29.

Figure 5:
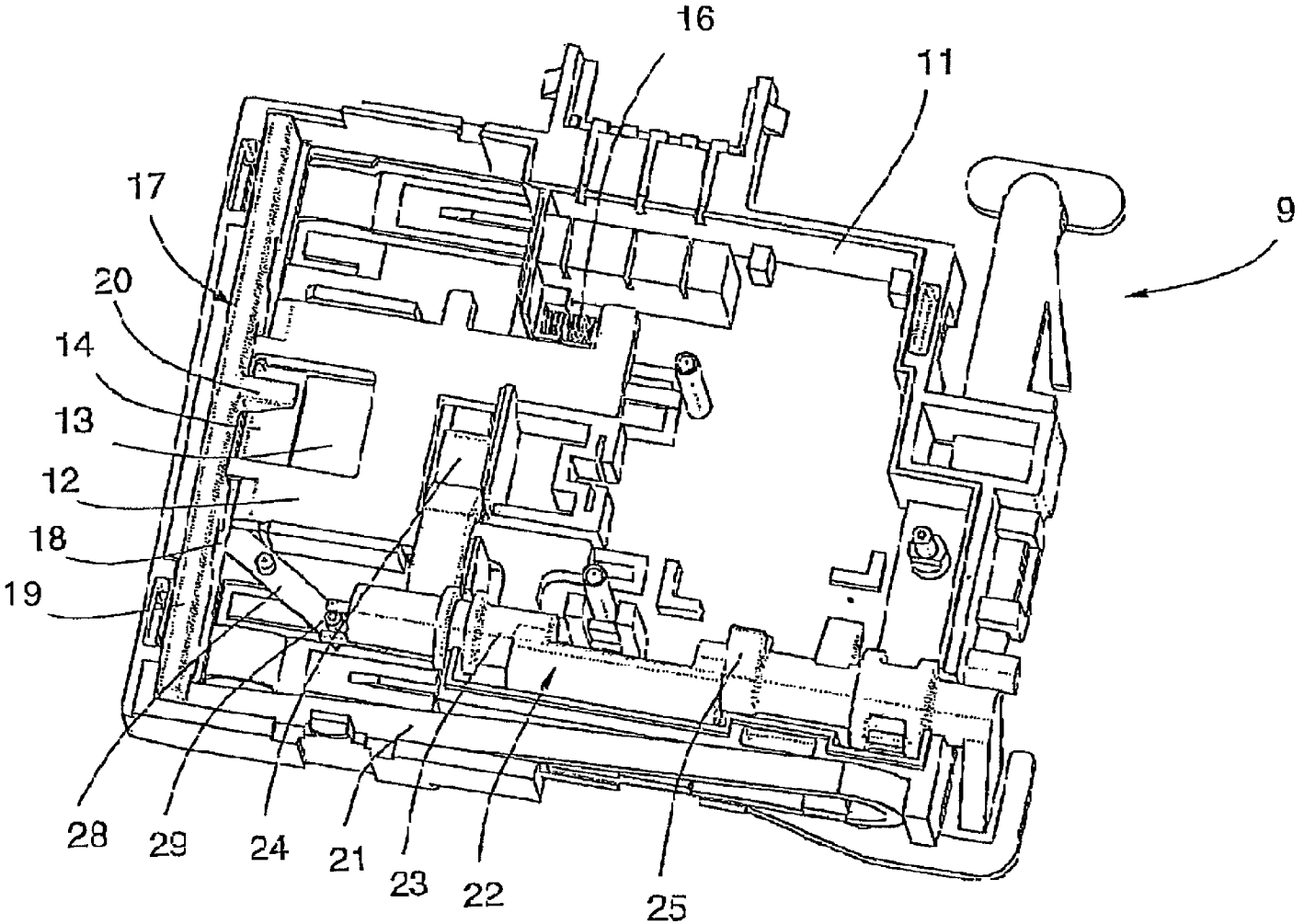
FIG. 5 shows the lock as in FIG. 3, with emergency opening being prevented.
Figure 14:
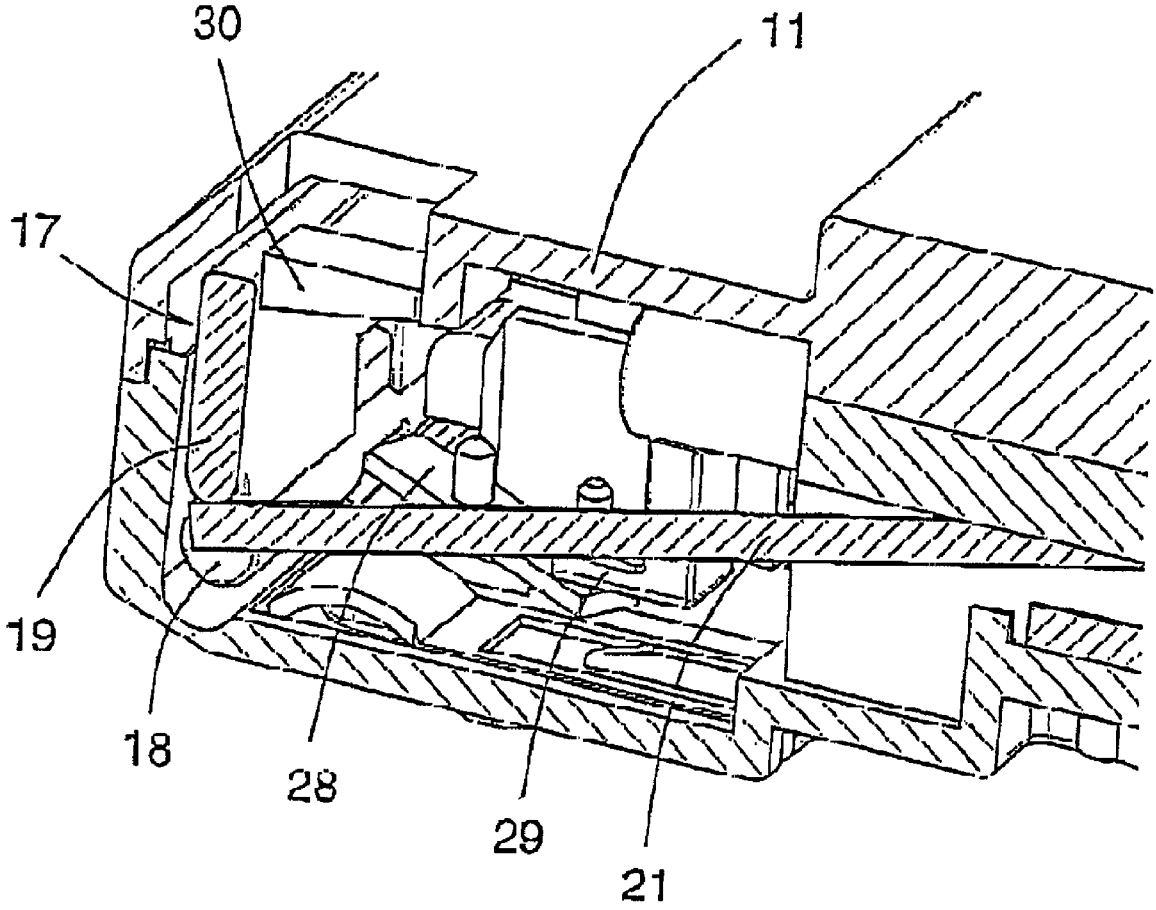
FIG. 14 shows a section as in FIG. 10, with emergency opening being prevented.

In the first state of the locking mechanism 22 as per FIG. 5, in which the movement of the slide 12 is blocked, the blocking plate 28 prevents the downward movement of the positive opener 17 counter to the force of the leaf spring 21, as a result of which a rotational movement of the positive opener 17 by the force of the closure hook 6 acting on the force engagement face of the blocking face 14 is prevented, which can also be seen from FIG. 14. In this way, it is not possible for the closure hook 6 to slide out of the slide 12, and the lock 9 remains closed even in the event of relatively large forces acting. In the second state of the locking mechanism 22, in accordance with FIG. 3, in which the movement of the slide 12 is freed, the blocking plate 28 does not prevent the downward movement of the positive opener 17 counter to the force of the leaf spring 21, as a result of which a rotational movement of the positive opener 17 by the force of the closure hook 6 acting on the force engagement face of the blocking face 14, as per the above description, is permitted.

Figure 15:
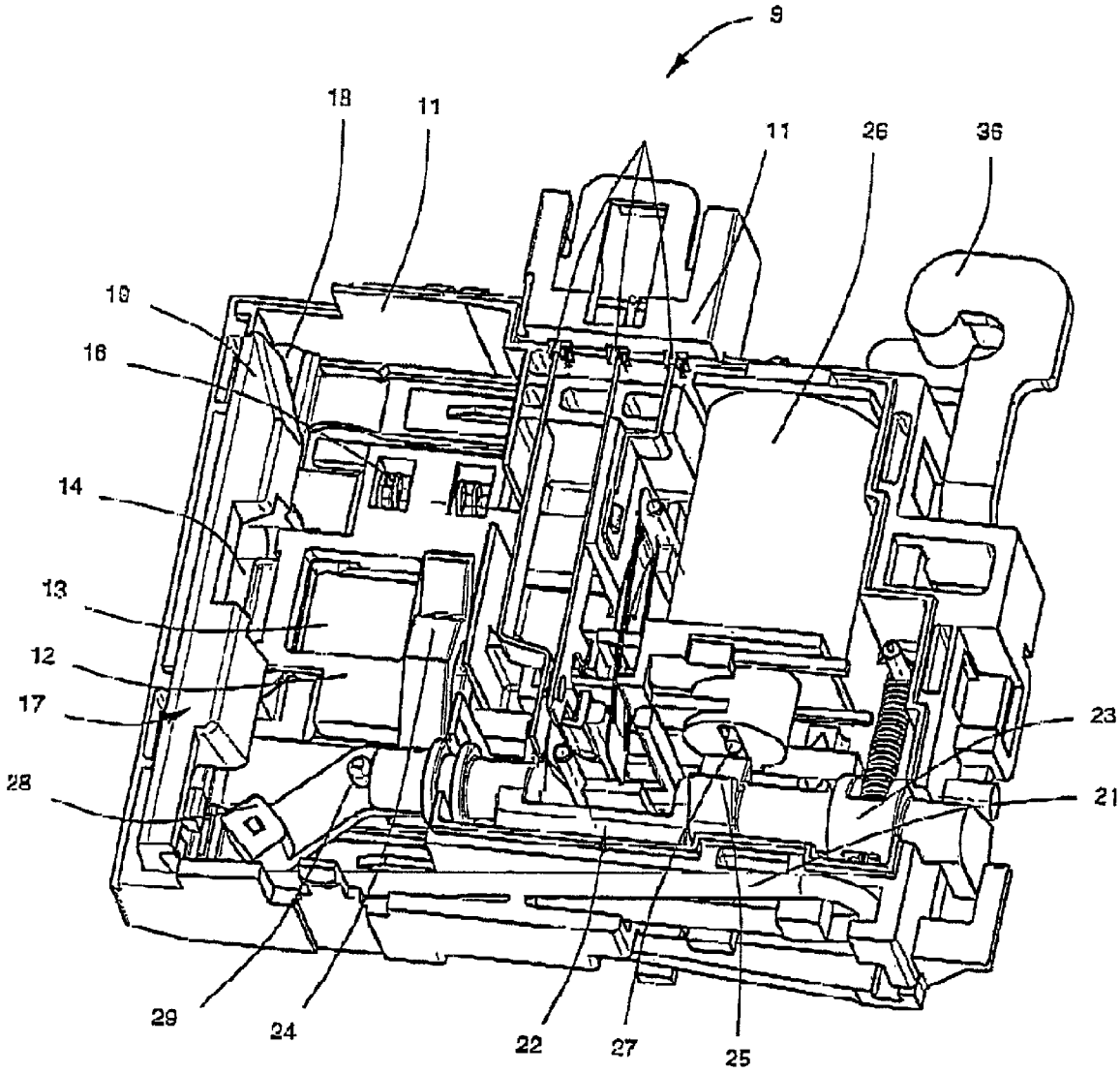
FIG. 15 shows the lock corresponding to a further exemplary embodiment in a perspective view.

In a further exemplary embodiment, which can be seen in greater detail in FIG. 15, the elastic force is generated by means of a leg spring 21 which is bent into approximately a fork shape and/or U shape. The shaft 18 of said lock 9 has a pivot axis 32 which is arranged offset with respect to the center 31 (see FIG. 20). Here, the pivot axis 32 is defined substantially by the contact of the shaft 18 against the housing 11. In this way, an increased lever arm acts as the positive opener 17 pivots back, with the lever arm being defined substantially by the connecting line between the center 31 and the pivot axis 32 on the shaft 18, so that, in an additional level of functionality, the positive opener 17 is automatically reset after the opening of the lock 9. As can also be seen from FIG. 20, the cross section of the shaft 18 which acts for the pivoting action is configured so as to be of a shape which deviates from circular, specifically in the present case so as to be of approximately half-moon-shaped or pear-shaped design. Only minor, cost-effective modifications are advantageously required here in comparison to the first exemplary embodiment in order to ensure the additional functionality. Also shown in FIG. 15 is an emergency bar 36 in order to permit the opening of the locking mechanism 22 by the user in order to open the door 2 in the event of a power failure, which prevents an actuation of the electromagnet 26.

A detailed description is also to be given below of the flinging-open process in the case of the lock 9 corresponding to the second exemplary embodiment.

Figure 16:
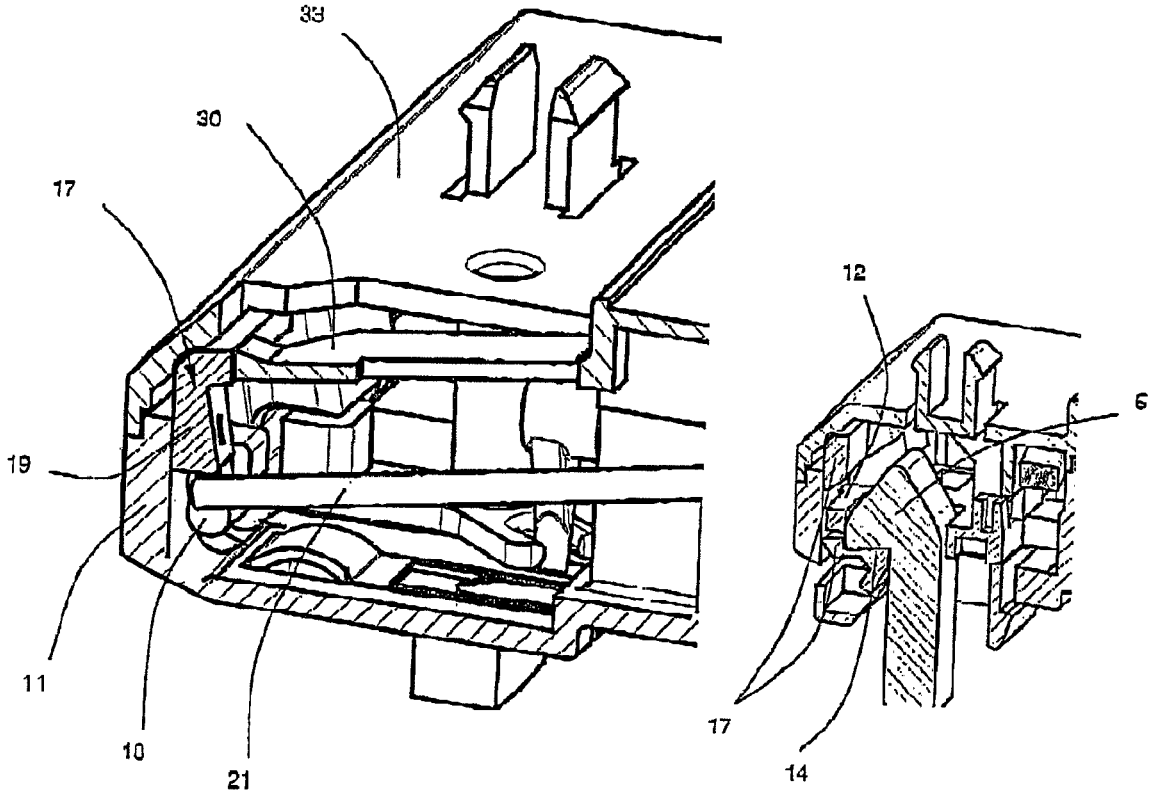
FIG. 16 shows the lock from FIG. 15 in the locked initial position.
Figure 17:
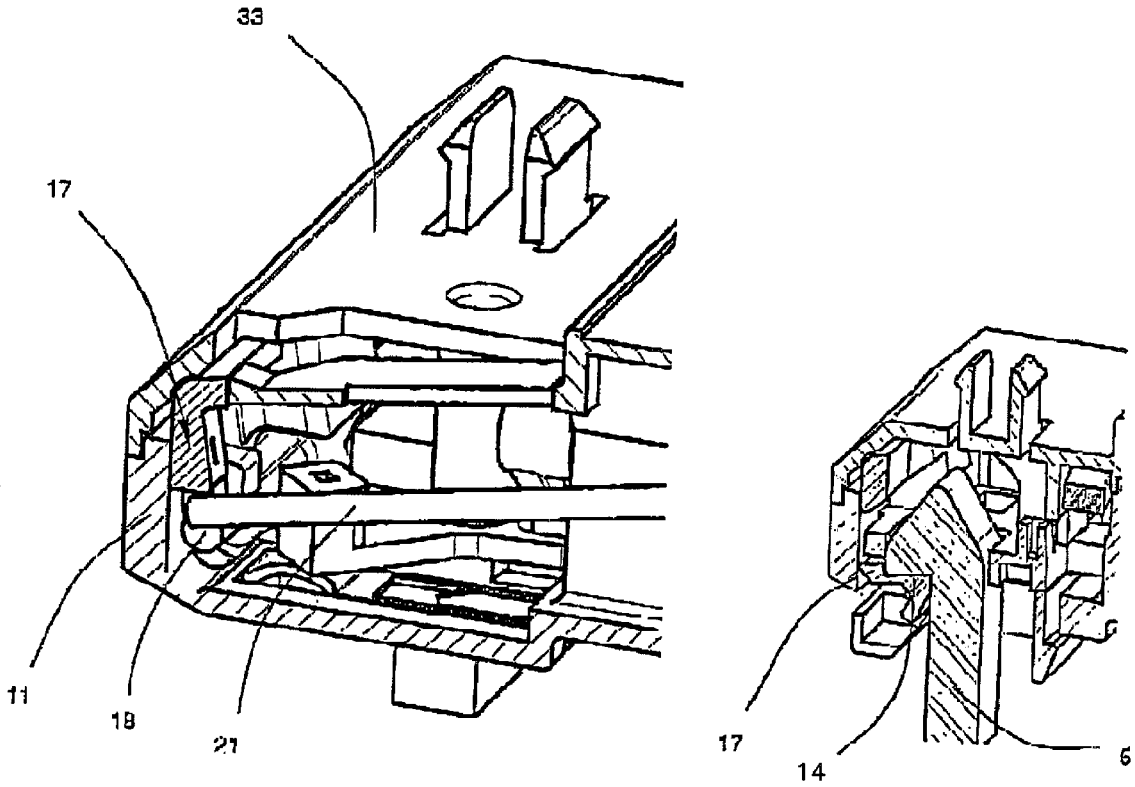
FIG. 17 shows the lock as in FIG. 16, but with unlocking having taken place.
Figure 18:
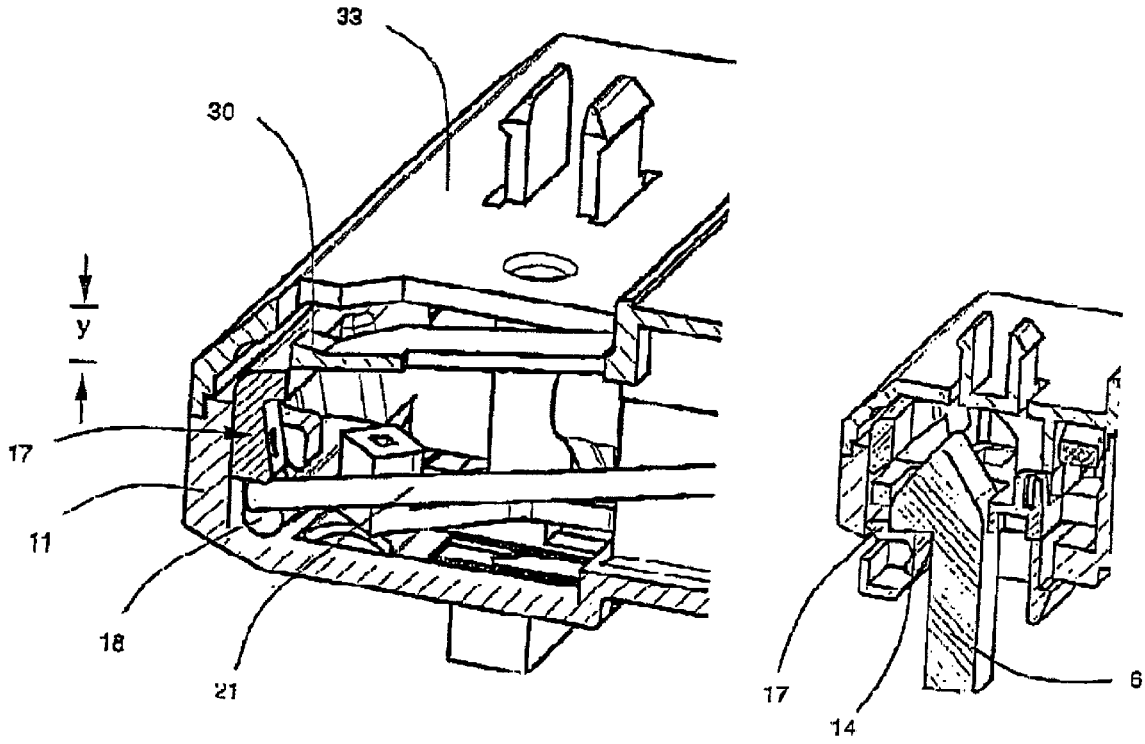
FIG. 18 shows the lock as in FIG. 17, with emergency opening being initiated from the inside.
Figure 19:
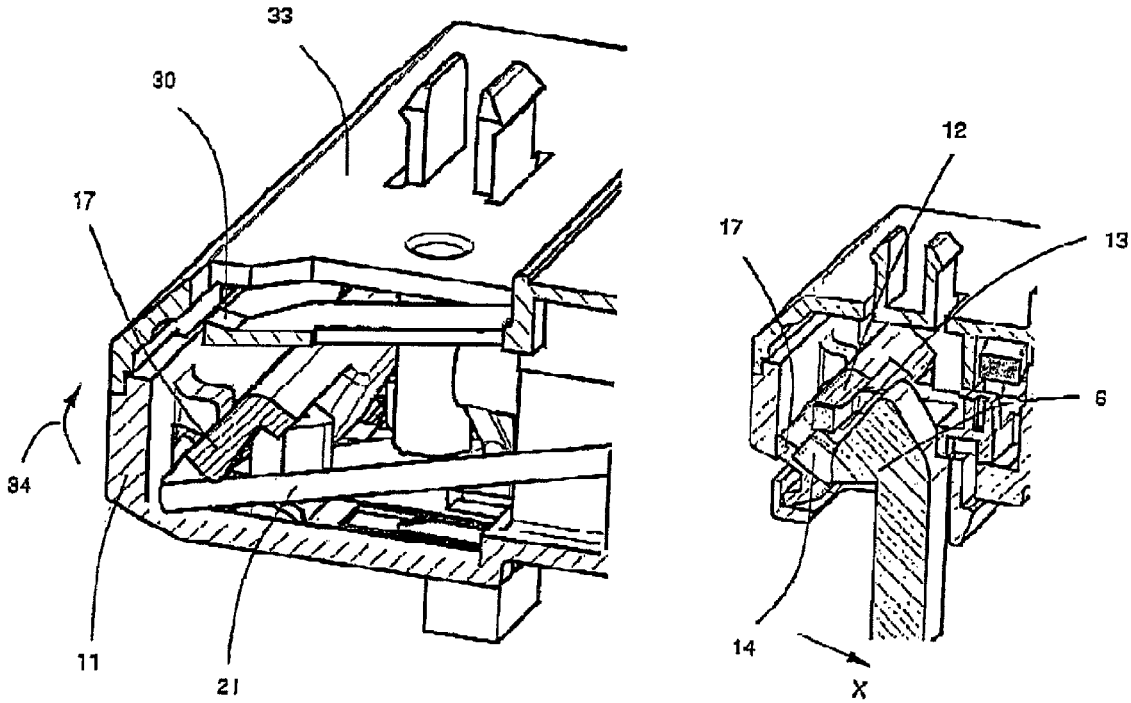
FIG. 19 shows the lock as in FIG. 18, but in the position in which the door is open.

FIG. 16 shows the locked position of the lock, with the closure hook 6 being located in the lock 9. In FIG. 17, the lock 9 has been unlocked. For emergency opening of the washing machine from the inside, corresponding to FIG. 18, a force is introduced by the closure hook 6 to the positive opener 17. The positive opener 17 is lowered on the side of the leg spring 21 by a certain magnitude, which is denoted in FIG. 18 by Y, and is then free from the counter bearing 30 which is located on the cover 33 for the housing 11. As a result of the persistence of the force acting on the closure hook 6, the positive opener 17 tilts by approximately 40°, corresponding to the arrow 34, and the closure hook 6 slides out of the closure 9 in the direction X, as can be seen in FIG. 19, so that the door 2 is open.

Figure 20:
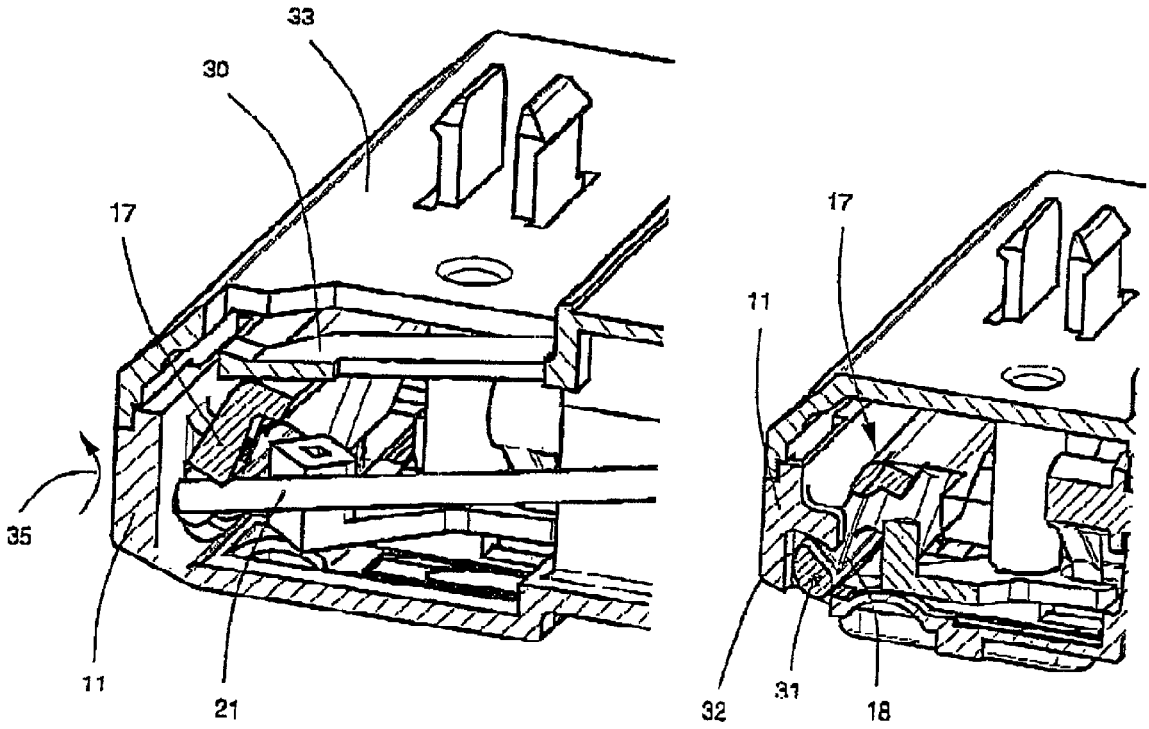
FIG. 20 shows the lock as in FIG. 19, with pivoting back into the initial position taking place.

In order to return to the initial position, the positive opener 17 tilts, as can be seen in FIG. 20, past the counter bearing 30 and back into the initial position, corresponding to the arrow 35. The energy required for this purpose is generated by the leg spring 21. The leg spring 21 bears by means of a lever arm against the positive opener 17. In order to provide sufficient torque for the restoring movement, which torque does not prevent the triggering of the child safety or emergency opening, the rotational axis 32 is offset from the center 31.

Figure 21:
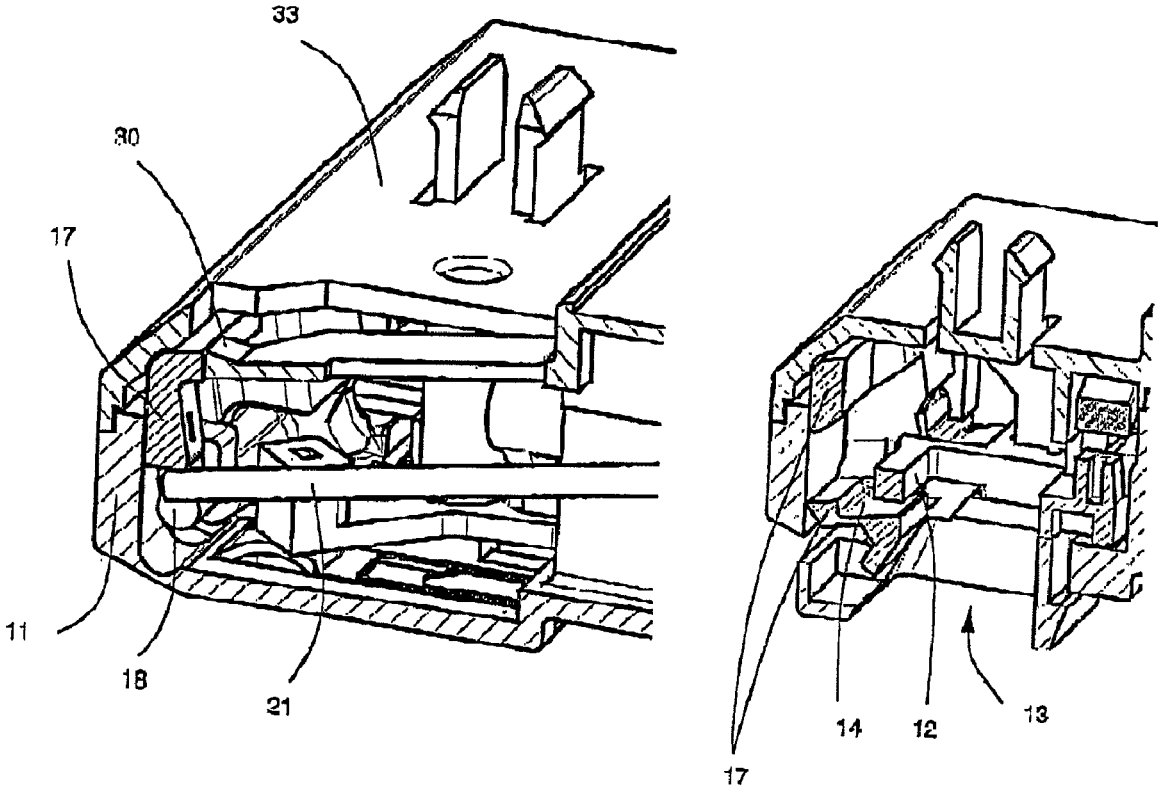
FIG. 21 shows the lock as in FIG. 20, with the initial position having been reached again.
Figure 22:
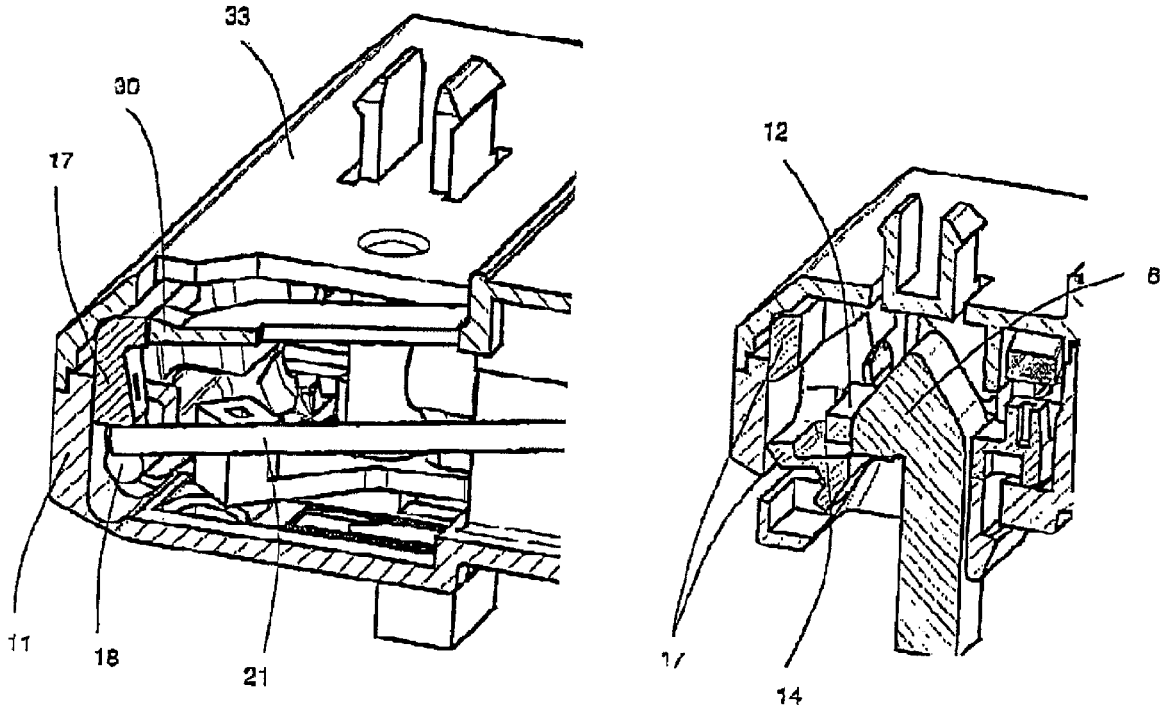
FIG. 22 shows the lock as in FIG. 21, with the door closed.
Figure 23:
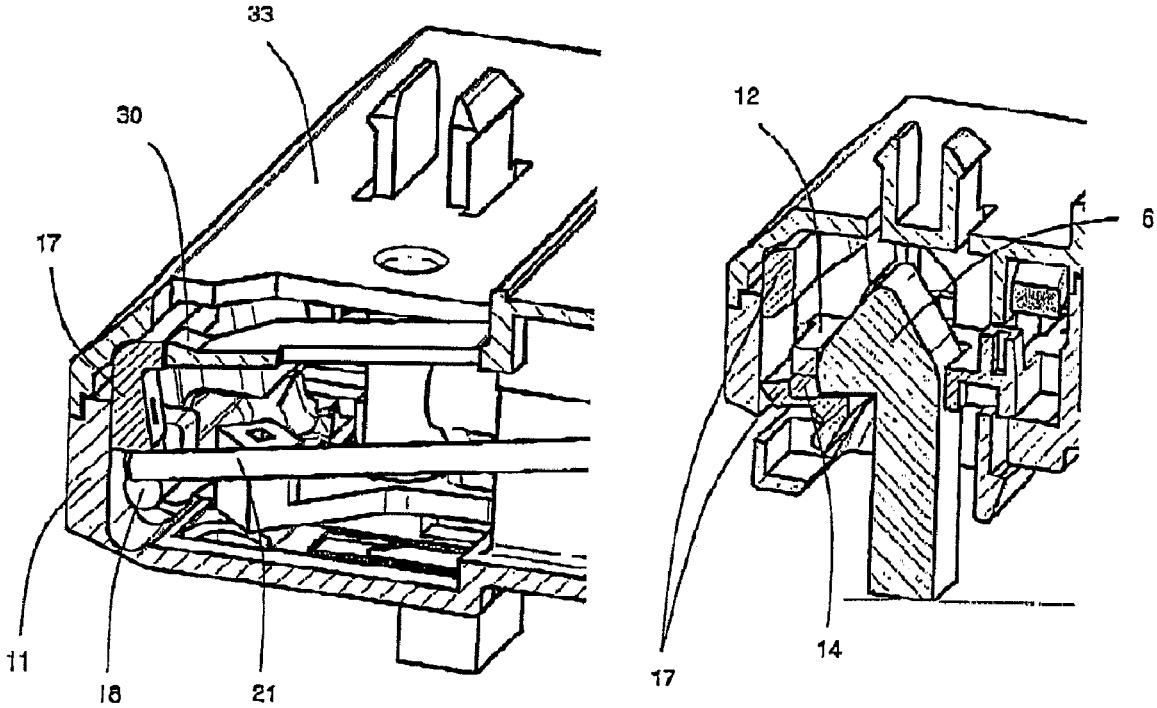
FIG. 23 shows the lock as in FIG. 22, with locking of the lock being permitted.

FIG. 21 shows the position in which the initial position of the positive opener 17 has been reached again. In FIG. 22, the door 2 of the washing machine is closed. The closure hook 6 passes here into the lock 9. The closure hook 6 correspondingly pushes the slide 12 forward, corresponding to FIG. 23, and the lock 9 can be locked again by means of the locking mechanism 22 (see FIG. 15).

The invention is not limited to the exemplary embodiments which have been described and represented. Rather, it also encompasses all expert refinements within the scope of the invention defined by the patent claims. Such a lock 9 can thus be used not only in household appliances 1 but also in other machines provided with a closure element, in particular where installation spaces are restricted. In addition, on account of the safety which the lock 9 according to the invention provides in emergency situations, use in motor vehicles, buildings or the like is also possible.

LIST OF REFERENCE NUMERALS

1: Household appliance
2: Closure element/door
3: Hinge
4: Body
5: Pivoting direction (for closure element)
6: Closure hook
7: Handle
8: Deflection direction (for closure hook)
9: Lock
10: Interior space (of the household appliance)
11: Housing (of lock)
12: Retaining element/slide
13: Opening (in housing)
14: Blocking face
15: Insertion bevel (on blocking face)
16: Spring (on retaining element)
17: Positive opener
18: Shaft
19: Carrier part
20: Lug
21: Leaf spring/leg spring
22: Locking mechanism
23: Blocking element
24: Blocking vane
25: Rocker switch
26: Electromagnet
27: Push rod
28: Blocking face
29: Fork-journal connection
30: Snap-action hook/counter bearing
31: Center (of shaft)
32: Pivot axis/rotational axis (of shaft)
33: Cover
34: Arrow (for the tilting of the positive opener)
35: Arrow (for the return pivoting of the positive opener)
36: Emergency bar

We claim:

1. A lock for a household appliance comprising a movable retaining element, which is configured as a slide biased by a biasing member, for interacting with a closure hook located on a closure element of the household appliance, which closure element can be moved between an open and a closed state, wherein the closure hook, in the closed state of the closure element, engages inside the retaining element, and is held inside the retaining element in contact against a blocking face such that a movement of the closure element into the open state is blocked, wherein the blocking face has a shaft for pivotably mounting the blocking face in a lock housing in the manner of a positive opener, wherein the blocking face is acted on at one side thereof with an elastic force in the movement direction of the closure hook, such that the blocking face, as a result of a force acting in the movement direction of the closure hook, is moveable at one side counter to the elastic force in such a way that a pivoting of the blocking face is permitted, and wherein the elastic force is generated by means of a spring.

2. The lock as claimed in claim 1, wherein a carrier part, which stands approximately perpendicularly on the blocking face, is arranged on the shaft inside the lock housing, and wherein a force is applied on the blocking face from a direction opposite the lock closing direction, the force displacing the carrier part to enable the blocking face to pivot.

3. The lock as claimed in claim 2, wherein a lug is situated on the carrier part, in such a way that the closure hook, during the movement of the closure element into the closed state, acts on the lug in order to pivot the blocking face back.

4. The lock as claimed in claim 1, further comprising an electromagnet positioned in the lock housing wherein a two-state locking mechanism interacts with the retaining element, in such a way that the locking mechanism in a first state blocks the movement of the retaining element and in a second state frees the movement of the retaining element, wherein the locking mechanism is electromagnetically controlled between the two states by the electromagnet.

5. The lock as claimed in claim 4, wherein the locking mechanism has a pivotable blocking element, such that the blocking element, at its one end, in the first state is in interaction with the retaining element and in the second state is free from interaction with the retaining element, wherein on the other end of the blocking element, a rocker switch, which is switchable between two settings, is operatively connected to an electromagnet, and wherein the operative connection is produced by means of a push rod which can be moved by means of the electromagnet, with the push rod engaging, for switching purposes, into a connecting link on the rocker switch.

6. The lock as claimed in claim 1, wherein a rotatable blocking plate interacts with the blocking face in such a way that a single-sided movement of the blocking face counter to the elastic force is controlled, wherein the blocking plate is rotated by means of the pivotable blocking element, and wherein the blocking plate can also be rotated by the blocking element via a fork-journal connection.

7. The lock as claimed in claim 2, wherein the shaft has a pivot axis which is arranged offset with respect to the center of the shaft, such that an increased lever arm acts as the positive opener pivots back.

8. The lock as claimed in claim 2, wherein the cross section of the shaft which acts for the pivoting action is configured so as to be of a shape which deviates from circular.

9. The lock as claimed in claim 1, wherein the spring is a leaf spring.

10. The lock as claimed in claim 1, wherein the spring is an approximately fork-shaped leg spring.

* * * * *